US005957735A

United States Patent [19]

Shinchi

[11] Patent Number: 5,957,735

[45] Date of Patent: Sep. 28, 1999

[54] ELECTRIC-WIRE CONNECTION STRUCTURE OF CONNECTOR

[75] Inventor: Akira Shinchi, Shizuoka-ken, Japan

[73] Assignee: Yazaki Corporation, Tokyo, Japan

[21] Appl. No.: 08/992,170

[22] Filed: Dec. 17, 1997

[30] Foreign Application Priority Data

Dec. 26, 1996 [JP] Japan ..... 8-348269

[51] Int. Cl.[6] ..... H01R 4/02

[52] U.S. Cl. ..... 439/874; 439/731

[58] Field of Search ..... 439/874, 867, 439/465, 731; 228/165, 110, 111; 174/92

[56] References Cited

U.S. PATENT DOCUMENTS

| | | | |
|---|---|---|---|
| 4,210,380 | 7/1980 | Brzostek | 439/687 |
| 5,134,249 | 7/1992 | Adachi | 174/92 |
| 5,199,899 | 4/1993 | Ittah | 439/687 |
| 5,569,050 | 10/1996 | Lloyd | 439/465 |

FOREIGN PATENT DOCUMENTS 7-70345 7/1995 Japan .

*Primary Examiner*—Paula Bradley
*Assistant Examiner*—Antoine Ngandjui
*Attorney, Agent, or Firm*—Finnegan, Henderson, Farabow, Garrett & Dunner, L.L.P.

[57] ABSTRACT

A covered electric wire is placed on a conductor drawn out onto a terminal retaining portion protruding from an end portion of a connector housing. When causing a core wire of the covered electric wire and the conductor to be conductively contacted with each other by oscillating ultrasonic waves while pressing the covered electric wire against the conductor by a cover closing the terminal retaining portion, the terminal retaining portion and the cover are positioned by positioning members which are fitted to each other and one of the two is thereby prevented from being displaced relative to the other.

3 Claims, 6 Drawing Sheets

ELECTRIC-WIRE CONNECTION STRUCTURE OF CONNECTOR

BACKGROUND OF THE INVENTION

1. Field of the Invention

The present invention relates to an electric-wire connection structure of a connector and, more particularly, to an electric-wire connection structure of a connector which is arranged to connect a conductor constituting a terminal of the connector and a covered electric wire by the use of ultrasonic wave oscillation.

2. Description of Relevant Art

FIGS. 1A and 1B and FIG. 2 show a conventional example of an electric-wire connection structure of a connector (see Japanese Patent Publication No. 7-70345).

The electric-wire connection structure shown in FIGS. 1A and 1B is equipped with a first member 23 having groove portions 22 formed therein and a second member 25 having convex portions 24 formed thereon, whereby a lead wire 26 and a contact member 27 are laminated in the groove portion 22 and the convex portion 24 is applied from above onto the resulting laminate in such a way as to clamp the resulting laminate between the convex portion 24 and the groove portion 22, whereby the first member 23 and the second member 25 are welded together by the use of ultrasonic vibration.

In the above-described connection structure, no positioning mechanism is provided with respect to the longitudinal direction of the first member 23 and the second member 25. Therefore, when the vibration made by ultrasonic oscillation is applied, the first member 23 is longitudinally displaced relative to the second member 25 as shown in FIG. 3, with the result that there occurs the phenomenon that the length T of connection in design actually becomes a length t of connection.

To prevent this, there is also a method which ultrasonically welds the first member 23 and the second member 25 in a state where these members are positioned using a jig 30 as shown in FIG. 4. However, in this method, the mounting and demounting of the jig 30 are complex and further interference of it with ultrasonic waves is also likely to occur. Therefore, this method is not practical.

SUMMARY OF THE INVENTION

The present invention has been achieved with such points in view.

It therefore is an object of the present invention to provide an electric-wire connection structure of a connector where a cover is accurately arranged to be ultrasonically welded without using a jig or the like thereby to obtain the predetermined length of connection of a core wire of a covered electric wire.

To achieve the object, a first aspect of the invention provides an electric-wire connection structure of a connector wherein the covered electric wire is placed on the conductor drawn out onto the terminal retaining portion caused to protrude from an end portion of the connector housing; and by applying ultrasonic vibrations to the cover closing the terminal retaining portion while the covered electric wire is being pressed against the conductor by means of this cover, the core wire of the covered electric wire is conductively contacted with the conductor and the cover is welded to the terminal retaining portion, whereby there are provided the positioning mechanisms which interfit with each other at each corresponding side of each of the terminal retaining portion and the cover.

According to the first aspect, a conductor is disposed in a terminal retaining portion and a covered electric wire is superposed on this conductor. And a cover is placed on the terminal retaining portion and corresponding ones of respective positioning mechanisms thereof are interfitted with each other, whereby the cover is welded by ultrasonic oscillation and a covering portion of the covered electric wire is welded and removed to thereby connect a core wire and the conductor. By the interfitting with each other of the positioning mechanisms, there is eliminated the possibility of the cover being displaced even when the resulting structure is vibrated by ultrasonic oscillation.

Accordingly, there is no possibility of the cover being displaced due to the vibration of the cover at the time of ultrasonic welding and so the cover can be welded at an accurate position, with the result that the covered electric wire can be connected to the terminal conductor in a state having a predetermined length of connection in designing stage.

A second aspect of the invention provides an electric wire connection structure of a connector wherein the positioning mechanisms at each corresponding side are constituted by a concave portion formed in the terminal retaining portion side and a welding rib formed on the cover side and fitted into the concave portion.

According to the second aspect, a cover is positioned by interfitting of concave portions and welding ribs with each other. At this time, since the welding rib per se has a positioning function, the positioning mechanism can be readily constructed and, simultaneously, as the welding rib is welded by being fitted into the concave portion, the cover is firmly fixed after being welded.

A third aspect of the invention provides an electric-wire connection structure of a connector wherein the positioning mechanisms at each corresponding side are constituted by a notched portion or hole portion formed in the terminal retaining portion side and a projecting portion formed on the welding rib of the cover side and fitted into the notched portion or hole portion.

According to the third aspect, a cover is positioned by interfitting of a notched portion or hole portion and a projecting portion with each other and simultaneously the projecting portion is lowered within the notched portion or hole portion while sliding. Therefore, even when the cover or the terminal retaining portion has a somewhat uneven thickness, a sufficient level of pressure contact force is obtained at a connection portion of a covered electric wire.

Accordingly, even when there is more or less a dispersion in the thickness of the cover or the terminal retaining portion, such dispersion is absorbed by the lowering of the cover, with the result that a sufficient level of pressure contact force is obtained at the connection portion of a core wire of the covered electric wire.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1A:
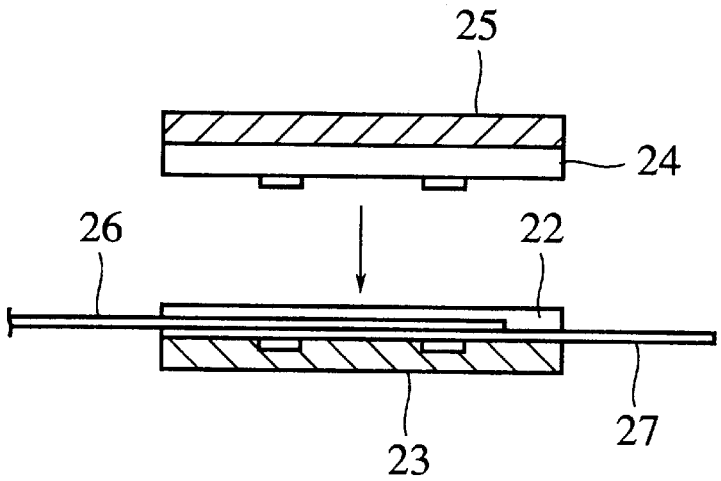
FIG.1A PRIOR ART
FIGS. 1A and 1B show a conventional electric-wire connection structure of a connector, FIG. 1A being a longitudinal side view and FIG. 1B being a right side view.
Figure 1B:
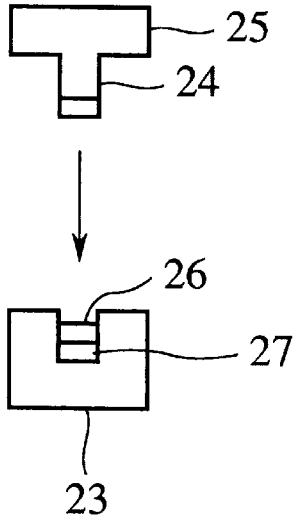
FIG.1B PRIOR ART
Figure 2:
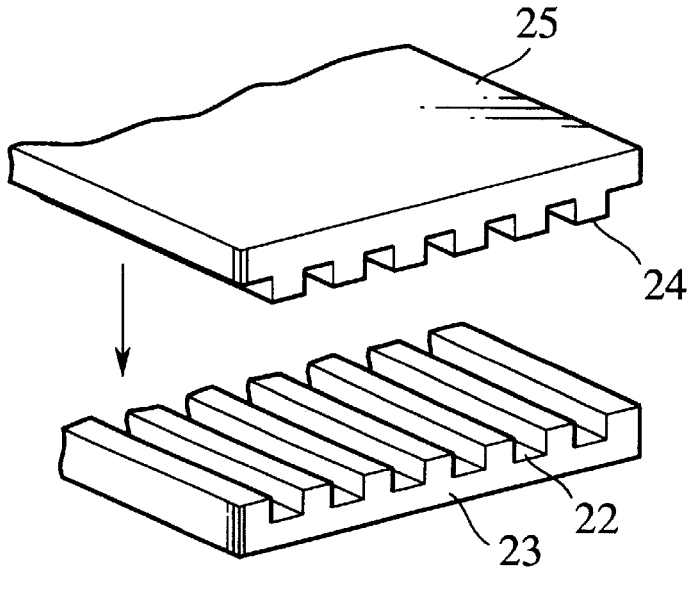
FIG.2 PRIOR ART
FIG. 2 is a perspective view of members used in the conventional electric-wire connection structure of the connector.
Figure 3:
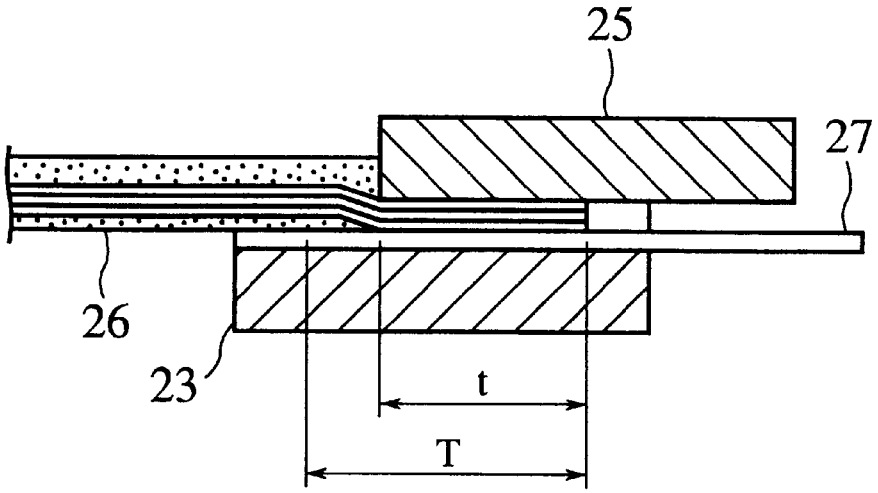
FIG.3 PRIOR ART
FIG. 3 is a section showing the function of the conventional electric-wire connection structure of the connector.
Figure 4:
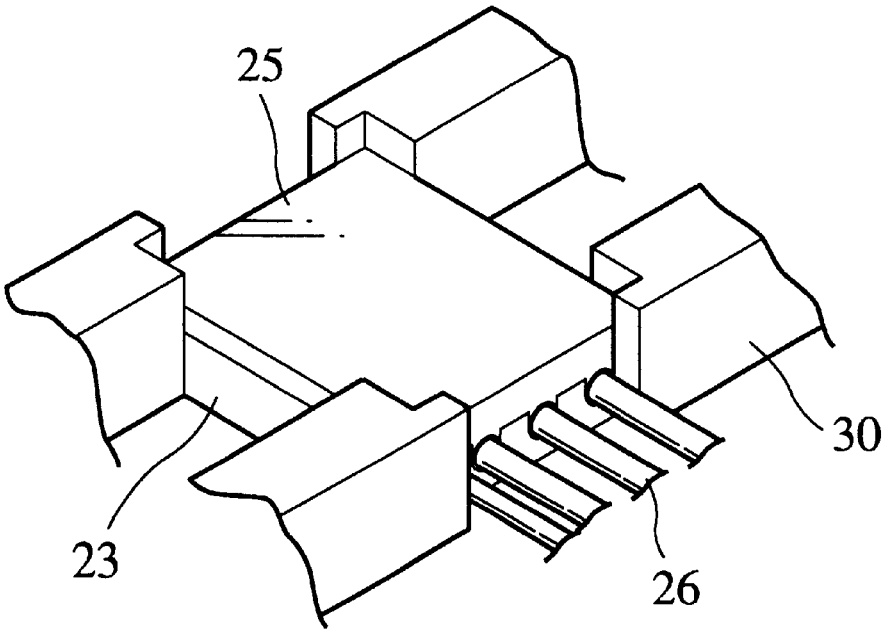
FIG.4 PRIOR ART
FIG. 4 is a perspective view of a manufactured example of the conventional electric-wire connection structure of the connector.

The contents of U.S. Pat. No. 5,584,122 are incorporated herein by reference.

There will be detailed below the preferred embodiments of the present invention with reference to the accompanying drawings. Like members are designated by like reference characters.

Figure 5B:
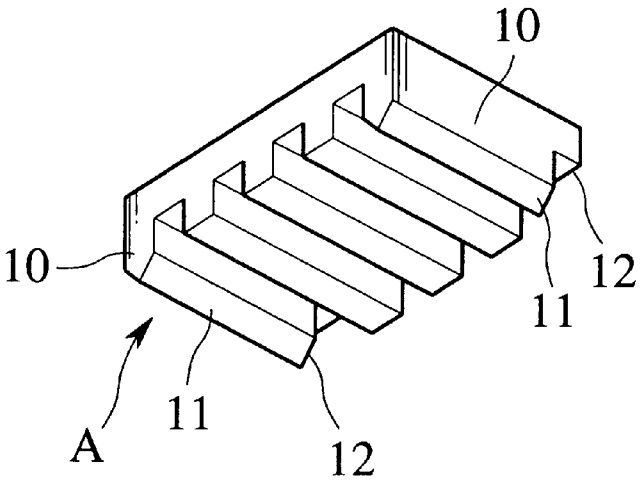
FIG. 5B is a perspective view showing a downside of a cover thereof.
Figure 5A:
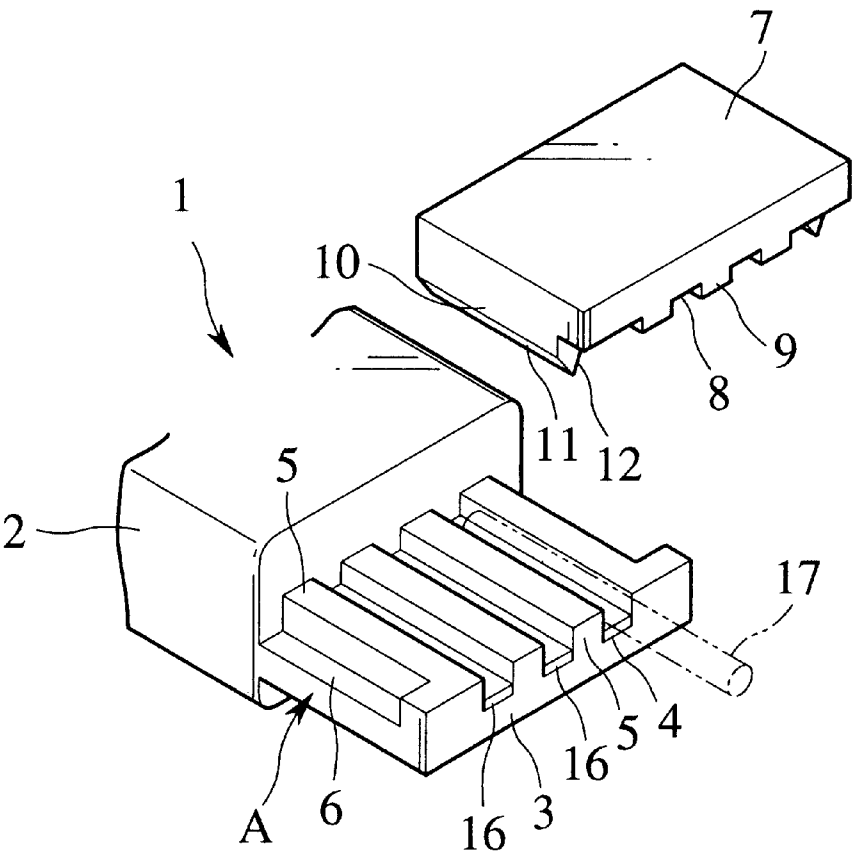
FIG. 5A is a perspective view of a manufacturing process of an electric-wire connection structure of a connector according to a first embodiment of the present invention.

FIGS. 5A and 5B show a first embodiment of the present invention, in which on a front portion of a connector housing 2 there is integrally formed a terminal retaining portion 3, the resulting structure as a whole being made of plastic. With respect to an upper surface of the terminal retaining portion 3 there are alternately formed groove portions 4 and convex portions 5 and, with respect to the outer sides of the outermost side convex portions 5 there are formed positioning members A.

This positioning members A is one wherein a right-angular notch is formed in a part of the outer side of the outermost convex portion 5 and has a construction wherein this notch is set to be a concave portion (see FIG. 5A).

With respect to an underside of a cover 7 there are alternately formed convex portions 9 and groove portions 8 corresponding to the groove portions 4 and the convex portions 5. With respect to the outermost sides of the cover 7, there are formed welding ribs 10 corresponding to the concave portions 6. This welding rib 10 has its forward end formed into a triangular or trapezoidal sharpened configuration by being made into a taper surface 11 to thereby cause concentrated application of ultrasonic waves. At one end of the welding rib 10 there is formed a notched portion 12 and the welding rib 10 is so formed that the length of the welding rib 10 may be substantially the same as the length of the concave portion 6 (see FIGS. 5A and 5B).

Next, a connection step of connecting a covered electric wire 17 and the connector housing 2 will be explained.

In the groove portion 4 of the terminal retaining portion 3 there is disposed a conductor 16 which has been integrated with or connected to a contact portion (not shown) within the housing 1. The covered electric wire 17 (see FIG. 5A) is superposed on this conductor 16. Subsequently, the cover 7 is placed on the terminal retaining portion 3, whereby the welding rib 10 is fitted into the concave portion 6. At this time, the inside taper surface 11 of the welding rib 10 is engaged with an upper portion of the outermost side convex portion 5 of the connector housing 2. As a result of this, the cover 7 is set in a state having been positioned with respect to the terminal retaining portion 3. In this state, the convex portions 5 and concave portion 4 of the terminal retaining portion oppose the concave portion 8 and convex portion 9 of the cover 7, respectively.

In this state, an ultrasonic horn (not shown) is applied onto the cover 7, thereafter to oscillate ultrasonic waves while a load is being applied to the cover 7. As a result of this, the cover 7 is lowered, the welding rib 10 is fitted into the concave portion 6 of the terminal retaining portion 3 and welded thereto, and a covering portion 17*b* of the covered electric wire 17 is molten and removed by the vibration of the convex portion 9 of the cover 7, whereby a core wire 17*a* is connected to the conductor 16, with the result that a connector 1 is completed (see FIG. 6). As the forward end of the welding rib 10 is sharpened by the both side taper surfaces 11, the welding of the welding rib 10 to the concave portion 6 is highly efficiently performed.

In this embodiment, the welding rib 10 per se has the positioning function. Therefore, the positioning members can be readily constructed and, as the welding rib 10 is welded by being fitted into the concave portion 6, the cover 7 is firmly fixed after having been molten.

Figure 7:
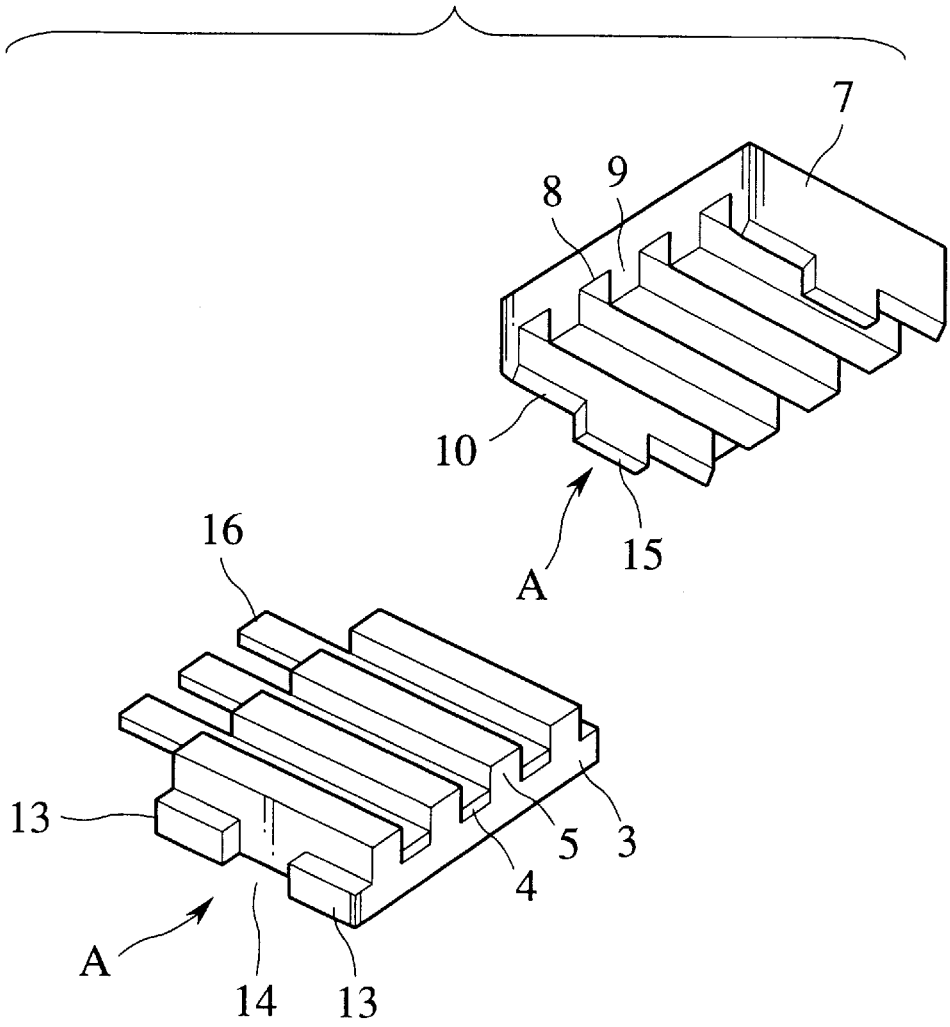
FIG. 7 is a perspective view of a terminal retaining portion and a cover according to a second embodiment of the present invention.

FIG. 7 shows a second embodiment. The positioning members A is constituted by a pair of rib receiving portions 13 and 13 protruding outwardly from the terminal retaining portion 3 and a notched portion 14 formed between the paired rib receiving portions 13 and 13. And, the welding rib 10 of the cover 7 is a protruding portion 15 to be fitted into the notched portion 13 which has been formed at an intermediate position of this welding rib 10. The remaining construction is the same as that of the first embodiment.

In this second embodiment, the positioning of the cover 7 is performed by the protruding portion 15 being fitted into the notched portion 14. In this state, an ultrasonic horn is applied onto the cover 7. When thereafter oscillating ultrasonic waves thereonto with a load being applied thereto, as the cover 7 is lowered, the protruding portion 15 is lowered along the notched portion 14 and the welding rib 10 is welded to the rib receiving portions 13. Simultaneously, as in the case of the first embodiment, the core wire 17*a* of the covered electric wire 17 and the conductor 16 are connected to each other.

Figure 8:
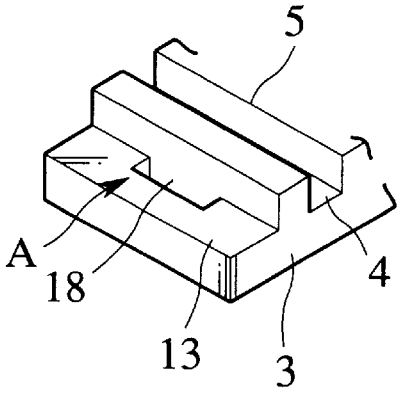
FIG. 8 is a partial perspective view of a terminal retaining portion, showing a variation of the second embodiment.

FIG. 8 shows a variation of the second embodiment, wherein a rib receiving portion 13 is of a continuous structure; and a hole portion 18 is formed instead of the above-mentioned notched portion 14, whereby it is arranged that the protruding portion 15 of the welding rib 10 is fitted into the hole portion 18. The remaining construction is the same as that of the second embodiment.

In the above-described second embodiment and the variation thereof, the protruding portion 15 of the welding rib 10 is slid along the notched portion 14 or hole portion 18 and therefore even when there is more or less a dispersion in the thickness of the terminal retaining portion or cover 7, such dispersion can be absorbed by the lowering of the cover 7.

Figure 9:
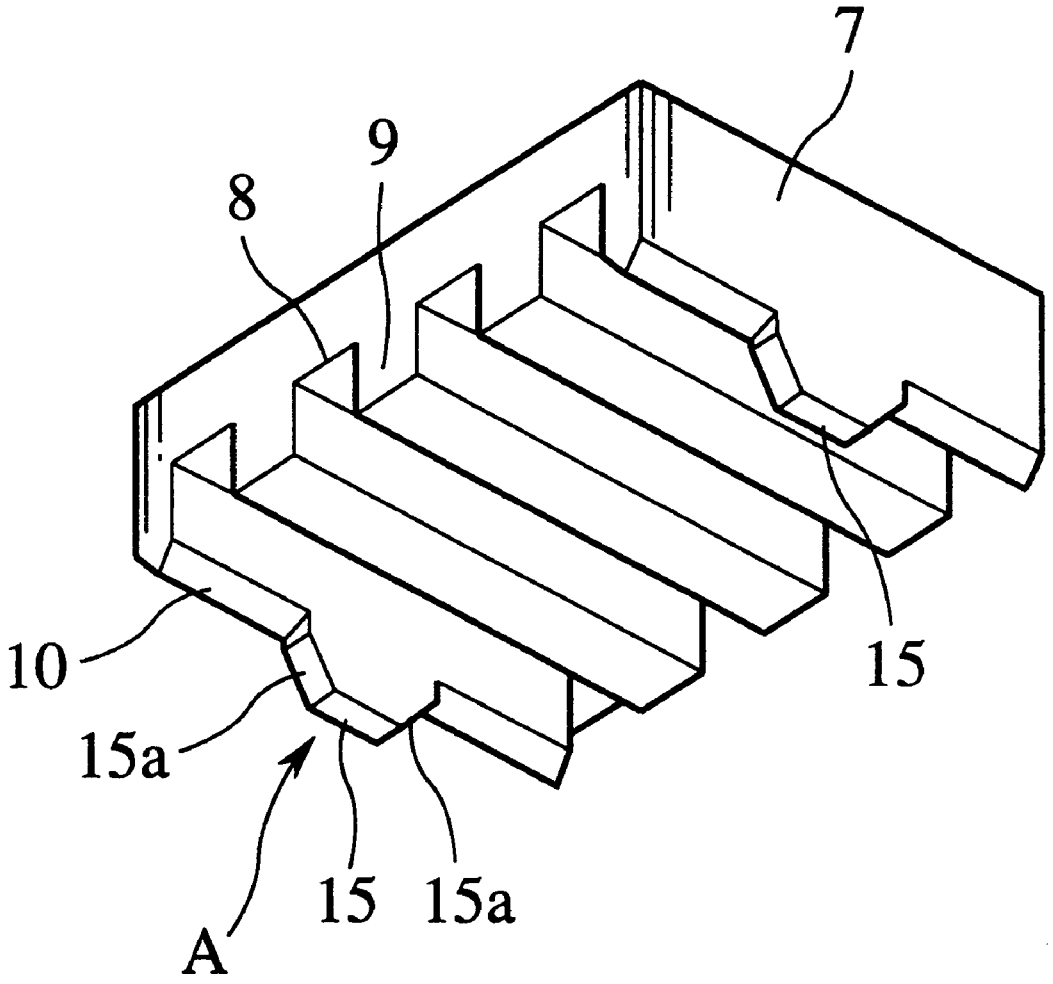
FIG. 9 is a downside perspective view of a cover used in another variation of the second embodiment.

FIG. 9 shows another variation of the second embodiment, wherein a protruding portion 15 has taper surfaces 15*a* formed on both sides thereof and is thereby formed as a whole into a sharpened configuration. For this reason, in this variation, the protruding portion 15 is easily fitted into the notched portion 14 or hole portion 18 by being guided by the taper surfaces 15*a*. As a result, the positioning is easy and so the operating efficiency is enhanced.

Figure 6:
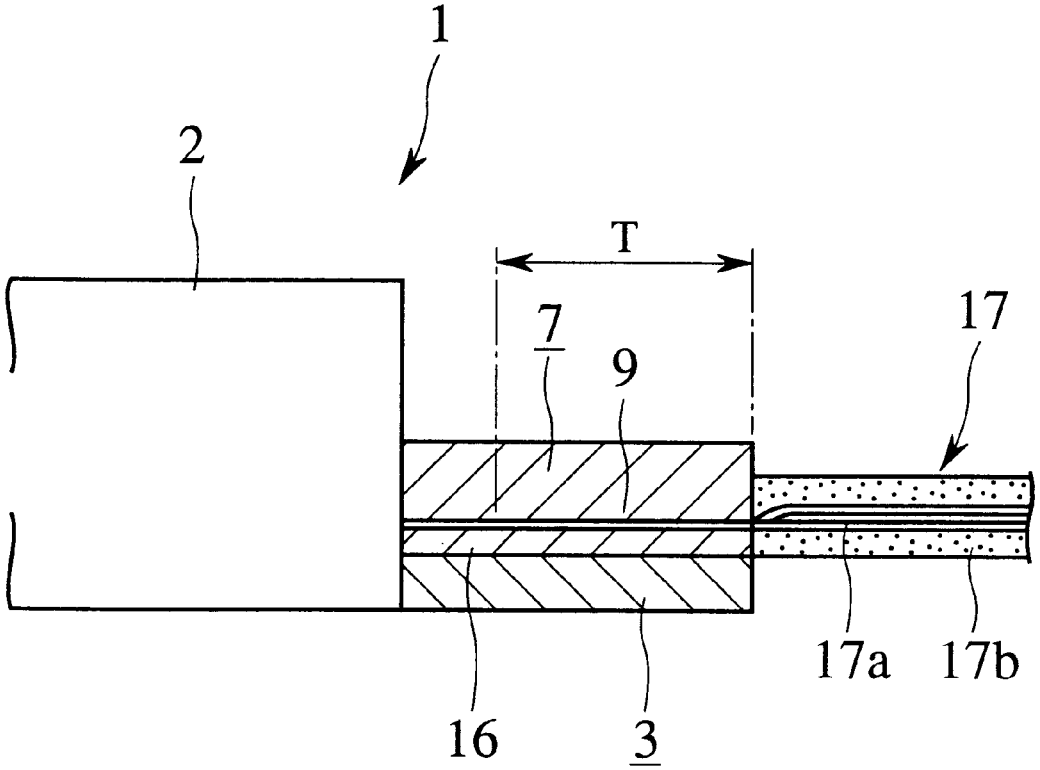
FIG. 6 is a section of the electric-wire connection structure, after completed, of the connector according to the first embodiment.

As described above, according to the embodiments of the present invention, the positioning members A such as the concave portion 6, notched portion 13 or hole portion 18 is formed in the terminal retaining portion 3 and on the other hand the welding rib 10 to be fitted with respect to the positioning members A is formed on the cover 7. Therefore, the cover 7 is welded to the terminal retaining portion 3 in a state having been positioned and in addition the cover 7 can be accurately welded without being displaced due to the oscillation of the ultrasonic waves and, therefore, the covered electric wire 17 can be connected to the conductor 16 in a state having the length T of connection in design as shown in FIG. 6.

While preferred embodiments of the present invention have been described using specific terms, such description is for illustrative purposes, and it is to be understood that changes and variations may be made without departing from the spirit or scope of the following claims.

What is claimed is:

1. An electric-wire connection structure of a connector comprising:

a connector housing;

a terminal retaining portion protruding from an end portion of the connector housing;

a conductor drawn out onto the terminal retaining portion;

a covered electric wire placed on the conductor;

a cover closing the terminal retaining portion; and positioning members provided on both sides of the terminal retaining portion and on both sides of the cover, the positioning members being interfitted with each other so that the displacement of the cover in the longitudinal direction of the connector housing is eliminated, wherein by applying ultrasonic vibration while the covered electric wire is being pressed against the conductor by the cover, a core wire of the covered electric wire and the conductor are conductively contacted with each other, so that the cover is welded to the terminal retaining portion.

2. An electric-wire connection structure of a connector according to claim 1, wherein the positioning members at each corresponding side are constituted by a concave portion formed in the terminal retaining portion side and a welding rib formed on the cover side being fitted into the concave portion.

3. An electric-wire connection structure of a connector according to claim 1, wherein the positioning members at each corresponding side are constituted by a notched portion or hole portion formed in the terminal retaining portion side and a projecting portion formed on a welding rib of the cover side being fitted into the notched portion or the hole portion.

* * * * *